US009804569B2

(12) United States Patent
Enta et al.

(10) Patent No.: US 9,804,569 B2
(45) Date of Patent: Oct. 31, 2017

(54) HAND UNIT AND TIMEPIECE

(71) Applicant: CASIO COMPUTER CO., LTD., Tokyo (JP)

(72) Inventors: Yoshihiko Enta, Saitama (JP); Junro Yano, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/058,360

(22) Filed: Mar. 2, 2016

(65) Prior Publication Data

US 2016/0357150 A1 Dec. 8, 2016

(30) Foreign Application Priority Data

Jun. 5, 2015 (JP) ..... 2015-114590

(51) Int. Cl.
*G04B 19/04* (2006.01)

(52) U.S. Cl.
CPC ..... *G04B 19/044* (2013.01); *G04B 19/042* (2013.01); *G04B 19/046* (2013.01)

(58) Field of Classification Search
CPC .... G04B 19/04; G04B 19/042; G04B 19/046; G04B 19/20; G04B 19/202; G04B 19/223; G04B 19/247; G04B 45/04
See application file for complete search history.

(56) References Cited

U.S. PATENT DOCUMENTS 605,269 A * 6/1898 Church ..... G04B 19/04 368/238
1,159,162 A * 11/1915 Besson ..... G04B 45/04 368/233
1,401,390 A * 12/1921 Caesar ..... G04B 19/223 368/27
1,475,800 A * 11/1923 Creasy ..... G04B 19/20 368/233
2,290,278 A * 7/1942 Failla ..... G02B 6/0008 116/287
2,293,459 A * 8/1942 Ewing ..... G04B 19/046 116/329

(Continued)

FOREIGN PATENT DOCUMENTS

JP H2-65183 U 5/1990
JP H11-258361 A 9/1999
WO 86/05006 A1 8/1986

OTHER PUBLICATIONS

Japanese Office Action dated Dec. 13, 2016, in a counterpart Japanese patent application No. 2015-114590. (A machine translation (not reviewed for accuracy) attached.).

*Primary Examiner* — Vit W Miska
(74) *Attorney, Agent, or Firm* — Chen Yoshimura LLP

(57) ABSTRACT

A hand unit for a timepiece, including: a hand for indicating time; and an attachment member including a support part attached to a rotational center of the hand so as to support the hand, and a cylindrical part defining a rotational axis of the hand and configured to be attached to a rotating shaft in the timepiece, the cylindrical part continuing from the support part extending towards a rear side of the timepiece along the rotational axis, wherein a bottom of the cylindrical part is at a position that is approximately the same or lower than a tip of the hand.

10 Claims, 6 Drawing Sheets

(56) References Cited

U.S. PATENT DOCUMENTS

| | | | | | |
|---|---|---|---|---|---|
| 2,444,392 | A * | 6/1948 | Willens | G04B 19/21 | 368/78 |
| 3,177,646 | A * | 4/1965 | Ernest | G04B 37/0066 | 359/440 |
| 3,472,021 | A * | 10/1969 | Karakawa | G04B 19/223 | 368/185 |
| 3,846,975 | A * | 11/1974 | Masui | G04B 19/044 | 368/233 |
| 6,891,778 | B1 * | 5/2005 | Hohenstein | G04B 19/04 | 368/223 |
| 8,009,521 | B2 * | 8/2011 | Wu | G04B 19/10 | 368/228 |

* cited by examiner

HAND UNIT AND TIMEPIECE

BACKGROUND OF THE INVENTION

The present invention relates to a hand unit and a timepiece.

The display units for timepieces and the like have traditionally been analog systems whereby a hand is attached to a hand shaft and the hand shaft is rotated in order to rotate the hand and perform various display functions such as time display.

The hand is generally rod-shaped or disk-shaped, and Patent Document 1, for example, discloses a timepiece having a rotary indication plate in which the respective rotational plates of the hour plate, minute plate, and second plate are attached to the corresponding hand shafts, instead of having individual hands for time display such as the hour hand, minute hand, and second hand.

These types of hands have an attachment member provided integrally therewith or separately on the side of the substrate edge where the hand is attached to the hand shaft, and this attachment member has a cylindrical part that supports the hand and is pressure-fitted thereto.

If a hand is provided with an attachment member in this manner, then when the hand is removed for repairs, maintenance, etc. of the timepiece, removal of the hand is performed by sliding a hand-removing tool below the hand and using the tool to catch the bottom of the attachment member and push it upwards.

If the hand extends approximately in parallel to the planar direction of the dial, such as with the disk hand described in Japanese Patent Application Laid-Open Publication No. H11-258361, then the hand-removing tool can be easily slid under the hand and the bottom of the attachment member can be easily caught or pinched with the tool.

There is demand, however, for the shape of the hand to be a disk shape that is highest at the center and gradually decreases in height towards the tip of the hand in order to further enhance the design characteristics of the display unit, for example.

If the hand has such a shape, then when removing the hand, it is difficult to slide the hand-removing tool to a position contacting the bottom of the attachment member, and if force is used to attempt to contact the bottom of the attachment member with the tool, the hand or the hand shaft may be damaged.

Accordingly, the present invention is directed to a scheme that substantially obviates one or more of the above-discussed and other problems due to limitations and disadvantages of the related art.

SUMMARY OF THE INVENTION

The present invention was made in view of the above and aims at providing a hand unit that can be easily removed with a tool and a timepiece.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a hand unit for a timepiece, including: a hand for indicating time; and an attachment member including a support part attached to a rotational center of the hand so as to support the hand, and a cylindrical part defining a rotational axis of the hand and configured to be attached to a rotating shaft in the timepiece, the cylindrical part continuing from the support part extending towards a rear side of the timepiece along the rotational axis, wherein a bottom of the cylindrical part is at a position that is approximately the same or lower than a tip of the hand.

It is to be understood that both the foregoing general description and the following detailed description are exemplary and explanatory, and are intended to provide further explanation of the invention as claimed.

DETAILED DESCRPTION OF EMBODIMENTS

Figure 1:
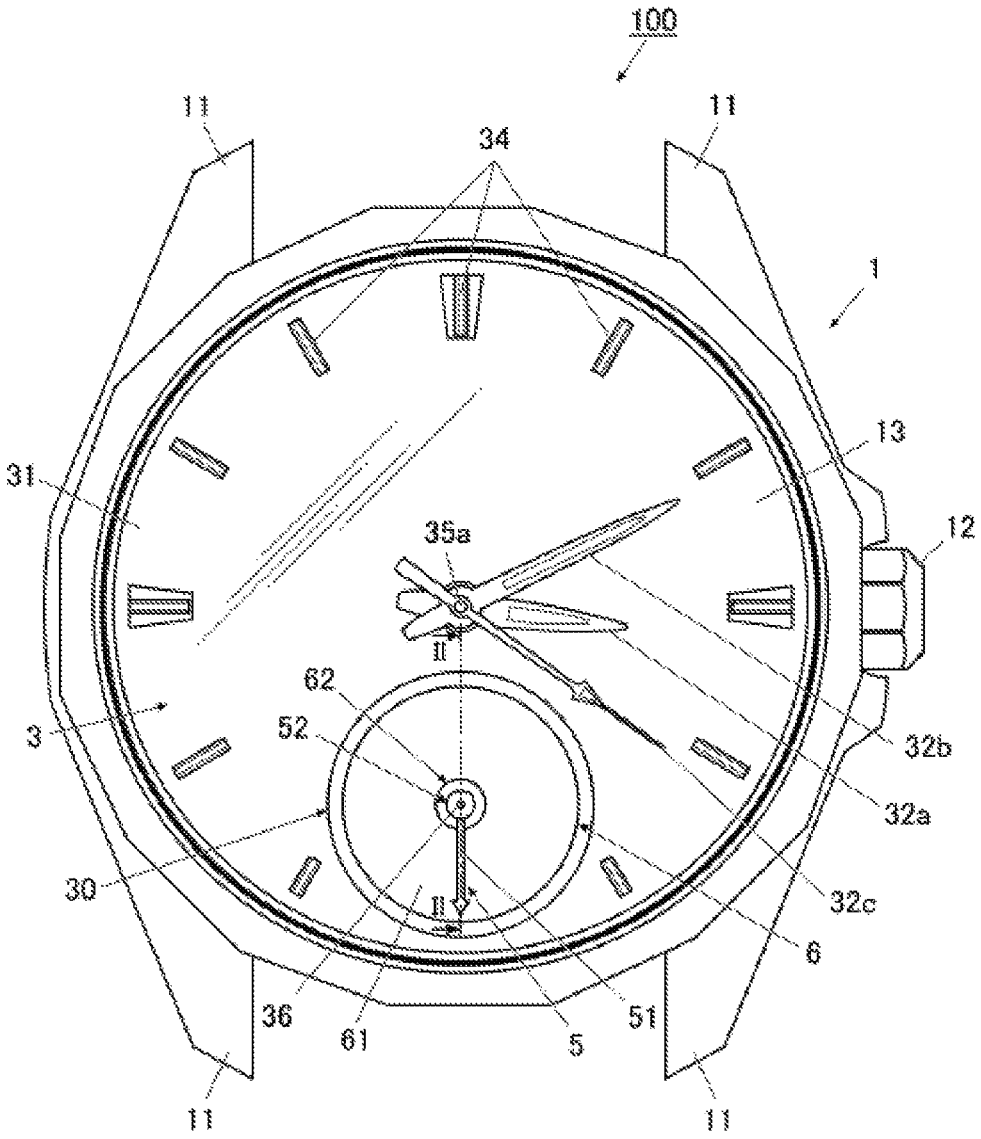
FIG. 1 is a front view of a timepiece that includes a hand unit of the present embodiment.

One example of a hand unit and a timepiece that includes the hand unit of the present invention will be explained below with reference to FIGS. 1 to 4.

It should be noted that, in the embodiments described below, there are various limitations that are technically favorable for implementing the present invention, but the scope of the present invention is not limited by the embodiments described below or the examples in the drawings.

FIG. 1 is a front view of a timepiece that includes a hand unit in one aspect of the present invention.

A timepiece 100 includes a case (hereinafter, "timepiece case 1") having a hollow short column shape with openings in the top and bottom thereof. Both ends on the top and the bottom of this timepiece case 1 in FIG. 1, or namely, the ends near 12 o'clock and 6 o'clock have band attachment members 11 to which a timepiece band (not shown) is attached.

The timepiece 100 also has an operation button 12 on the side etc. of the timepiece case 1. The operation button 12 is connected to a timepiece module 4 (described later) and the insertion end of the button is housed inside the timepiece case 1. This enables various types of operations via pushing or turning of the operation button 12.

The viewer's side (front surface side) of this timepiece case 1 has a transparent windshield member 13 made of glass or the like fixed thereon via a waterproof ring (not shown), and the windshield member 13 is fixed so as to close the aperture on the viewer's side.

In addition, a rear cover member (not shown) is attached to the side of the timepiece case 1 opposite to the viewer's side (i.e., the rear surface side) via a waterproof ring (not shown), and this rear cover member acts as a closing member that closes the aperture below the timepiece case 1.

Furthermore, a display unit 3 is provided inside the timepiece case 1 below the windshield member 13.

As shown in FIG. 1, the display unit 3 of the present embodiment is an analog unit that includes a dial 31, and an hour hand 32*a*, minute hand 32*b*, second hand 32*c*, and the like above this dial 31. Time members 34, which serve as a general indicator of the time displayed by the hour hand 32*a*, minute hand 32*b*, and second hand 32*c*, are arranged at the tips of the hands on the front surface side of the dial 31.

In the present embodiment, a small display unit 30 having functional hands 51 and 61 that constitute the hand units 5 and 6 (described later) is disposed above the dial 31.

The timepiece module 4 is provided inside the timepiece case 1 and below the display unit 3 (in other words, on the rear surface side of the timepiece 100).

Figure 2:
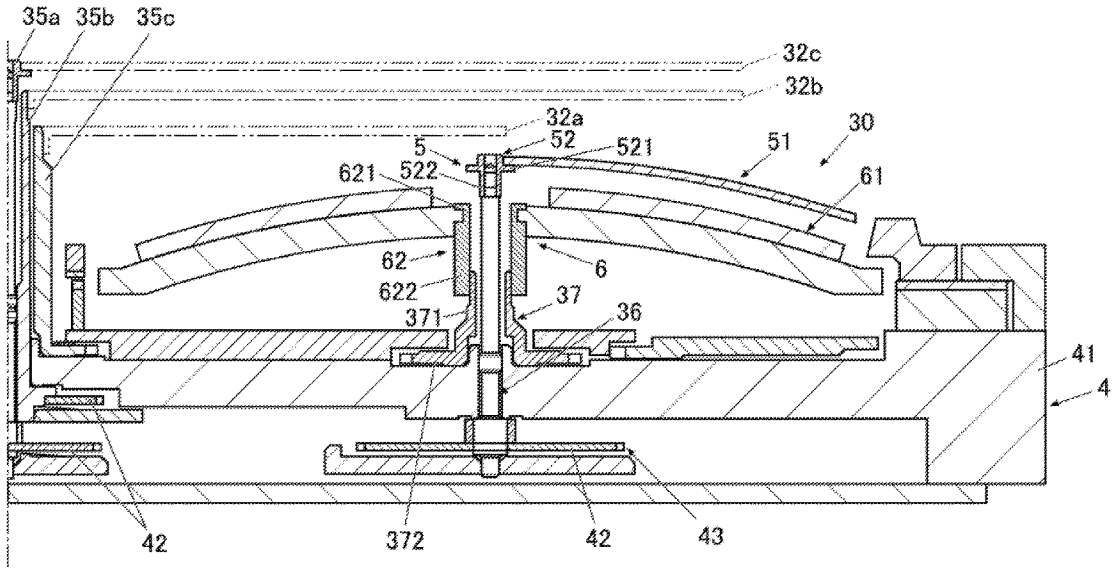
FIG. 2 is a cross-sectional view of main components of a small display unit from FIG. 1 and the peripheral parts thereof.

FIG. 2 is a cross-sectional view showing main components along the line II-II in FIG. 1, or namely, the small display unit 30 and the portion of the timepiece module 4 corresponding to this. The timepiece module 4 includes a hand movement unit 43 that has wheels 42, a motor (not shown), etc. inside a housing 41 made of resin or the like. Although not shown, the timepiece module 4 has embedded therein a circuit substrate with various types of electronic components or the like mounted thereon, a battery for supplying power for the various functions of the timepiece 100, and the like.

A shaft hole (not shown) is formed in approximately the center of the dial 31 of the display unit 3, and a hand shaft 35*a* connected to the timepiece module 4 and cannon pinions 35*b* and 35*c* provided on the same axis as the hand shaft 35*a* protrude beyond the front surface of the dial 31 from the rear surface via the shaft hole. The hand shaft 35*a* and cannon pinions 35*b* and 35*c* are shaft units of the hand movement unit 43.

The second hand 32*c*, minute hand 32*b*, and hour hand 32*a* are respectively attached to the ends of the protruding hand shaft 35*a* and cannon pinions 35*b*, 35*c*. The timepiece module 4 causes the hour hand 32*a*, minute hand 32*b*, and second hand 32*c* attached to the hand shaft 35*a* and cannon pinions 35*b*, 35*c* to rotate above the dial 31 by causing the hand shaft 35*a* and the cannon pinions 35*b* and 35*c* to rotate.

Figure 3:
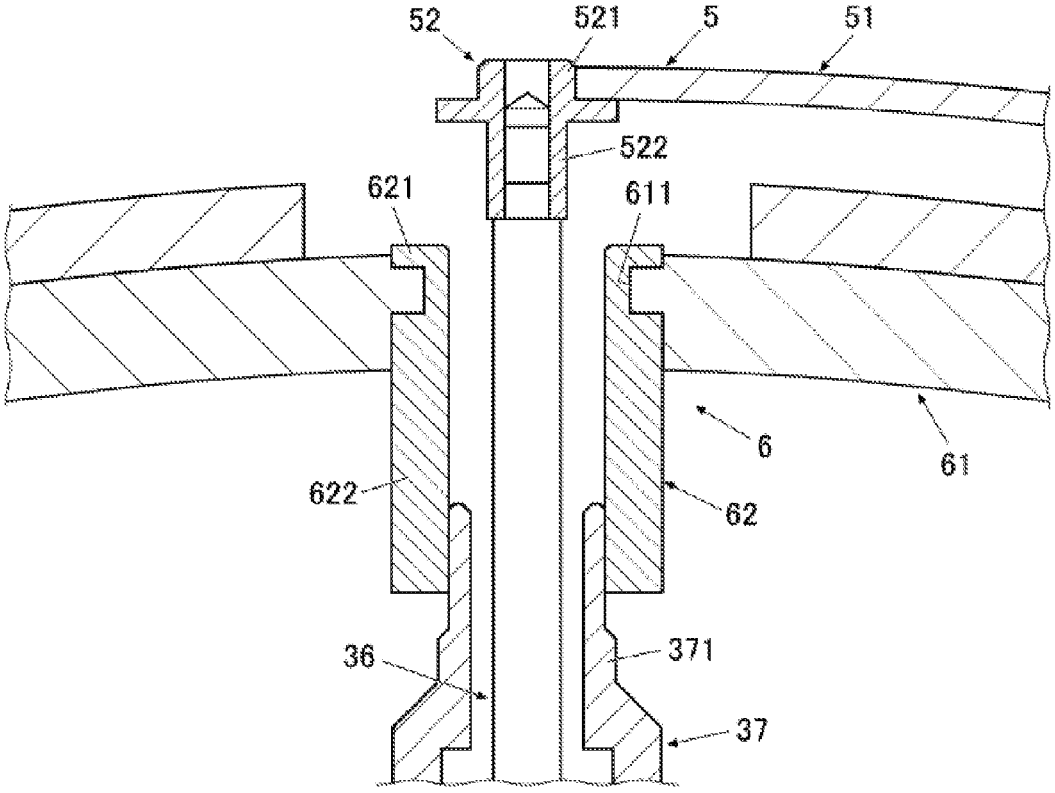
FIG. 3 is a cross-sectional view in which a fixing part of the hand unit and a hand shaft from FIG. 2 have been expanded.

FIG. 3 is a cross-sectional view in which a fixing part of the hand unit and a hand shaft from FIG. 2 have been expanded.

As shown in FIGS. 2 and 3, in approximately the middle of the area where the small display unit 30 is provided, a hand shaft 36 having the base end sides thereof connected to the timepiece module 4, and a hand shaft 37 provided on the same axis as the hand shaft 36 and having a cylindrical part 371 through which the hand shaft 36 passes, protrude from inside of the timepiece module 4 towards the surface of the dial 31. The hand shafts 36 and 37 are shaft units of the hand movement unit 43.

In the present embodiment, the hand unit 6 is constituted by a functional hand 61, and an attachment member 62, and the functional hand 61 is attached to the cylindrical part 371 of the hand shaft 37 via the attachment member 62.

Specifically, the attachment member 62 includes a support part 621 and a cylindrical part 622. The support part 621 is attached to the center (rotational center) of the functional hand 61 and supports the functional hand 61. The cylindrical part 622 defines a rotational axis of the hand and is configured to be attached to a rotating shaft unit in the timepiece, and the cylindrical part continues from the support part 621 and extends towards a rear side of the timepiece along the rotational axis. Furthermore, the cylindrical part 622 has the hand shaft 37, which is the above-mentioned shaft unit (rotating shaft unit) of the hand movement unit 43, inserted therein. The functional hand 61 attaches to the hand shaft 37 by the cylindrical part 622 of the attachment member 62 being pressure-fitted to the cylindrical part 371 of the hand shaft 37.

The functional hand 61, which is a hand of the present embodiment, has a shape whereby the tip of the hand is positioned below the center. In other words, the functional hand 61 is a disk-shaped hand (disk hand) in which the center of the hand is the highest part and the hand becomes progressively lower towards the tip of the hand (the dial 31), which is the free end. The method, angle, shape etc. of the slant of the functional hand 61 have no particular limitations, but in the present embodiment the entire functional hand 61 is gradually curved and has an approximately spherical outer shape.

As shown in FIG. 3, a penetrating hole 611 is provided in the center of the functional hand 61. Furthermore, the support part 621 of the attachment member 62 is attached to this penetrating hole 611. In the present embodiment, the position of the bottom of the cylindrical part 622 of the attachment member 62 is at approximately the same height as or lower than the tip of the functional hand 61 (i.e., the position of the portion of the hand near the dial 31).

The bottom of the cylindrical part 371 of the hand shaft 37 has an integrally-provided wheel 372 that connects to a wheel, motor, or the like (not shown) inside the timepiece module 4. The timepiece module 4 rotates the hand shaft 37 via the wheel 372 to rotate the functional hand 61 attached to the hand shaft 37 inside the small display unit 30.

In addition, in the present embodiment, the hand unit 5 is constituted by a functional hand 51, and an attachment member 52, and the functional hand 51 is attached to the protruding edge of the hand shaft 36 via the attachment member 52.

Specifically, the attachment member 52 includes a support part 521 and a cylindrical part 522. The support part 521 is attached to the side that is opposite to the tip of the functional hand 51, which is a hand, and supports the functional hand 51. The cylindrical part 522 continues from the support part 521, and the hand shaft 36, which is a shaft unit of the hand movement unit 43, is inserted inside the cylindrical part. The functional hand 51 attaches to the hand shaft 36 by the cylindrical part 522 of the attachment member 52 being pressure-fitted to the tip of the hand shaft 36.

The functional hand 51 rotates above the functional hand 61. Furthermore, the functional hand 51 is gradually curved so as to follow the surface shape of the functional hand 61. The functional hand 51 slants such that the section thereof attached to the support part 521 is highest, and the hand becomes progressively slanted (profiled) towards the tip of the hand, which is the free end. The functional hand 51 is a rod-shaped hand.

The bottom of the hand shaft 36 is connected to the wheel 42 inside the timepiece module 4. The hand shaft 36 is connected to a motor and the like (not shown) via the wheel 42. The timepiece module 4 rotates the hand shaft 36 to rotate, inside the small display unit 30, the functional hand 51 attached to the hand shaft 36.

Next, the hand unit of the present embodiment and the effects of a timepiece using this hand unit will be described.

When assembling the timepiece 100 in the present embodiment, the timepiece module 4, dial 31, and the like are arranged inside the timepiece case 1, and the second hand 32*c*, minute hand 32*b*, and hour hand 32*a* are respectively attached to the hand shaft 35*a* and cannon pinions 35*b*, 35*c* protruding from the timepiece module 4 towards the center of the surface of the dial 31.

Furthermore, the small display unit 30 having the hand units 5 and 6 are arranged near 6 o'clock on the dial 31 (the bottom in FIG. 1). The hand unit 5 is formed by attaching the functional hand 51 to the support part 521 of the attachment member 52. The hand unit 6 is formed by attaching the functional hand 61 to the support part 621 of the attachment member 62. When attaching the hand units 5 and 6 to the timepiece 100, first the cylindrical part 622 of the attachment member 62 to which the functional hand 61 on the bottom is attached is pressure-fitted to the tip of the cylindrical part 371 of the hand shaft 37 constituting the hand movement unit 43 of the timepiece module 4.

Next, the cylindrical part 522 of the attachment member 52 to which the functional hand 51 above the functional hand 61 is attached is pressure-fitted to the tip of the hand shaft 36 constituting the hand movement unit 43 of the timepiece module 4. This completes the attaching of the hand units 5 and 6 to the timepiece 100. Once the timepiece module 4, hand units 5, 6, and the like are arranged inside the timepiece case 1, the windshield member 13 is attached so as to close the aperture in the surface side of the timepiece case 1 (the viewer's side). This completes the timepiece 100.

During repairs, maintenance, or the like, when removing the functional hands 51 and 61 from the timepiece 100, first a hand-removing tool (not shown) is slid below the functional hand 51 disposed on top. Thereafter, the tool catches or pinches and then pushes up the bottom of the attachment member 52 to raise the functional hand 51 and remove the hand from the hand shaft 36. Next, a hand-removing tool (not shown) is slid under the functional hand 61 disposed below the functional hand 51. Thereafter, the tool catches or pinches the bottom of the attachment member 62 to raise the functional hand 61 and remove the hand from the hand shaft 37.

The functional hand 61 of the present embodiment has a curved surface shape in which the tip of the hand is lower than the center. However, the position of the bottom of the attachment member 62 is at approximately the same position as or lower than the tip of the functional hand 61. Therefore, it is possible to easily catch or pinch the bottom of the attachment member 62 with a tool, which can make the removal operation of the functional hand 61 smooth and easy.

Removal of a hand in a conventional hand unit will be explained with reference to FIG. 4.

Figure 4:
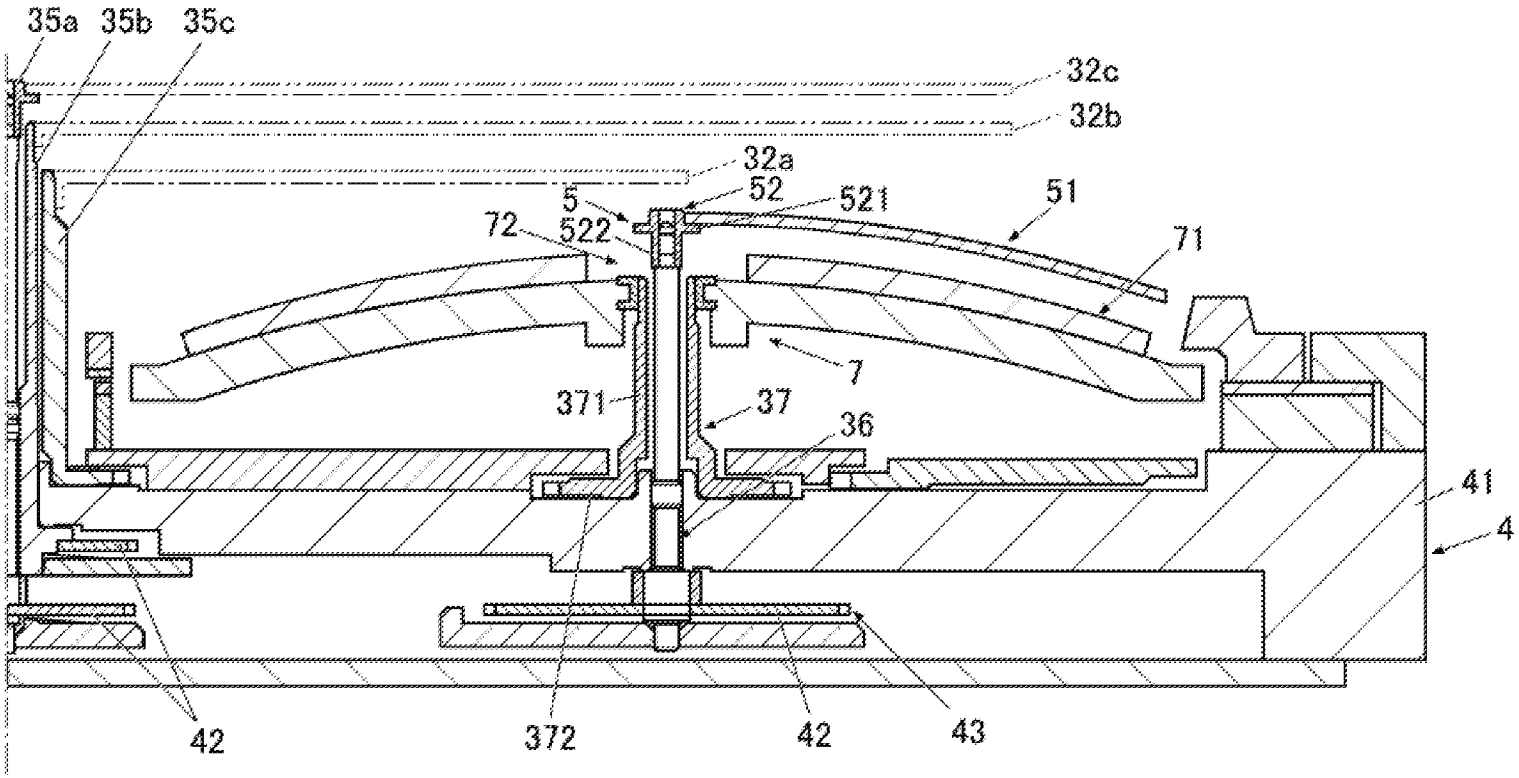
FIG. 4 is a cross-sectional view of main components of a conventional hand unit and the peripheral parts thereof.

FIG. 4 is a cross-sectional view of main components of a conventional hand unit 7 including an attachment member 72 attached to a functional hand 71 (hand) that has, similar to the present embodiment, a tip that is lower than the center. As shown in FIG. 4, the conventional attachment member 72 is a short cylindrically-shaped member, and the functional hand 71, which is a hand, is attached to the periphery of the attachment member.

In this case, the position of the bottom of the attachment member 72 is higher than the tip of the functional hand 71. Therefore, when attempting to remove the functional hand 71, even if the hand-removing tool is slid under the functional hand 71, it is difficult to catch or pinch the bottom of the attachment member 72. Thus, there is a risk that the functional hand 71 or the hand shaft 37 to which the functional hand is attached may be damaged during the removal work.

In comparison, it is easy to catch the bottom of the attachment member 62 when the position of the bottom of the cylindrical part 622 of the attachment member 62 is below the position of the tip of the functional hand 61, as in the present embodiment. Accordingly, the functional hand 61 can be removed with damaging the functional hand 61 or the hand shaft 37 to which the functional hand is attached.

As described above, in the present embodiment, the shape of the functional hand 61, which is a hand of the hand unit 6, slants downward from the center of the hand towards the free end, and the tip of the hand is lower than the center. Furthermore, the position of the bottom of the cylindrical part 622 of the attachment member 62 that supports the functional hand 61 is approximately the same as or lower than the tip of the functional hand 61, or namely, the free end of the functional hand 61.

Therefore, when removing the functional hand 61, it is easy to catch the bottom of the attachment member 62 with a hand-removing tool or to use the tool to pinch the bottom of the attachment member 62. Thus, the functional hand 61 can be removed easily and smoothly without damaging the functional hand 61, which is a hand, or the hand shaft 37.

Moreover, the functional hand 61 of the present embodiment has a disk-shape (disk hand) in which the center is highest, and the hand progressively slants downward toward the tip of the hand, which is the free end. Accordingly, this disk-shaped hand can perform various types of display functions that are impossible with a rod-shaped hand, and can realize various types of display units 3 with excellent design characteristics. Even if the tip of the disk hand is lower than the center, the position of the bottom of the cylindrical part 622 of the attachment member 62 is approximately the same or lower than the free end of the functional hand 61, which makes removal of the functional hand 61 smooth and easy.

Even if the hand slants downward from the center to the free end in this manner, the hand can be easily removed from the timepiece 100 without damaging the hand or the hand shaft. This makes it possible to increase the degree of freedom for the shape of the hand and to realize a timepiece 100 having various types of hands with excellent design characteristics.

Embodiments of the present invention were described above, but the present invention is not limited to these embodiments, and various modification can be made without departing from the gist of the present invention.

For example, in the present embodiment, an example was shown in which a functional hand 61, which is a hand, has an external appearance that is approximately a spherical disk-like hand (disk hand) having a cross-sectional shape gradually curving such that the shape is highest at the center and progressively lower towards the tip of the hand, which is the free end. However, the shape of the hand is not limited to this.

Alternatively, the hand may be a conical-shaped hand (disk hand) having a cross-sectional shape linearly slanted such that the center is highest and the hand is progressively lower towards the tip of the hand, which is the free end, for example.

Furthermore, in the present embodiment, an example was shown in which only the position of the bottom of the cylindrical part 622 of the attachment member 62 is approximately the same position as or a lower position than the free end of the functional hand 61. However, the present invention is not limited to this.

Alternatively, the position of the bottom of the cylindrical part of the attachment member 52 belonging to the hand unit 5 having the rod-shaped functional hand 51 may be approximately the same position as or a lower position than the free end of the functional hand 51, for example.

In such a case, as above, regardless of the shape of the functional hand 51, it will be easy to catch or pinch the attachment member 52 with a hand-removing tool and to safely removing the functional hand 51 without damaging the hand or the hand shaft.

Furthermore, in the present embodiment, a scenario was described in which the functional hand 61 slants downward from the center to the free end, and the tip of the hand is lower than the center, but the hand having this type of shape is not limited to being a functional hand.

The hands attached to the hand shaft 35*a* and cannon pinions 35*b*, 35*c* in the center of the dial 31 such as the hour hand 32*a*, minute hand 32*b*, and second hand 32*c*, for example, may slant downward from the attachment member side to the free end side and the respective tips thereof may be lower than the attachment member side.

In such a case, the attachment member supports the hour hand 32*a* or the like, and the position of the bottom of the cylindrical part of the attachment member is approximately the same position as or a lower position than the free end of the hour hand 32*a* or the like.

In addition, in the present embodiment, an example was described in which the cylindrical part 622 of the attachment member 62 is pressure-fitted to the tip of the cylindrical part 371 of the hand shaft 37, but the configuration of the connection portion of the cylindrical part 622 and the hand shaft 37 is not limited to this.

Figure 5:
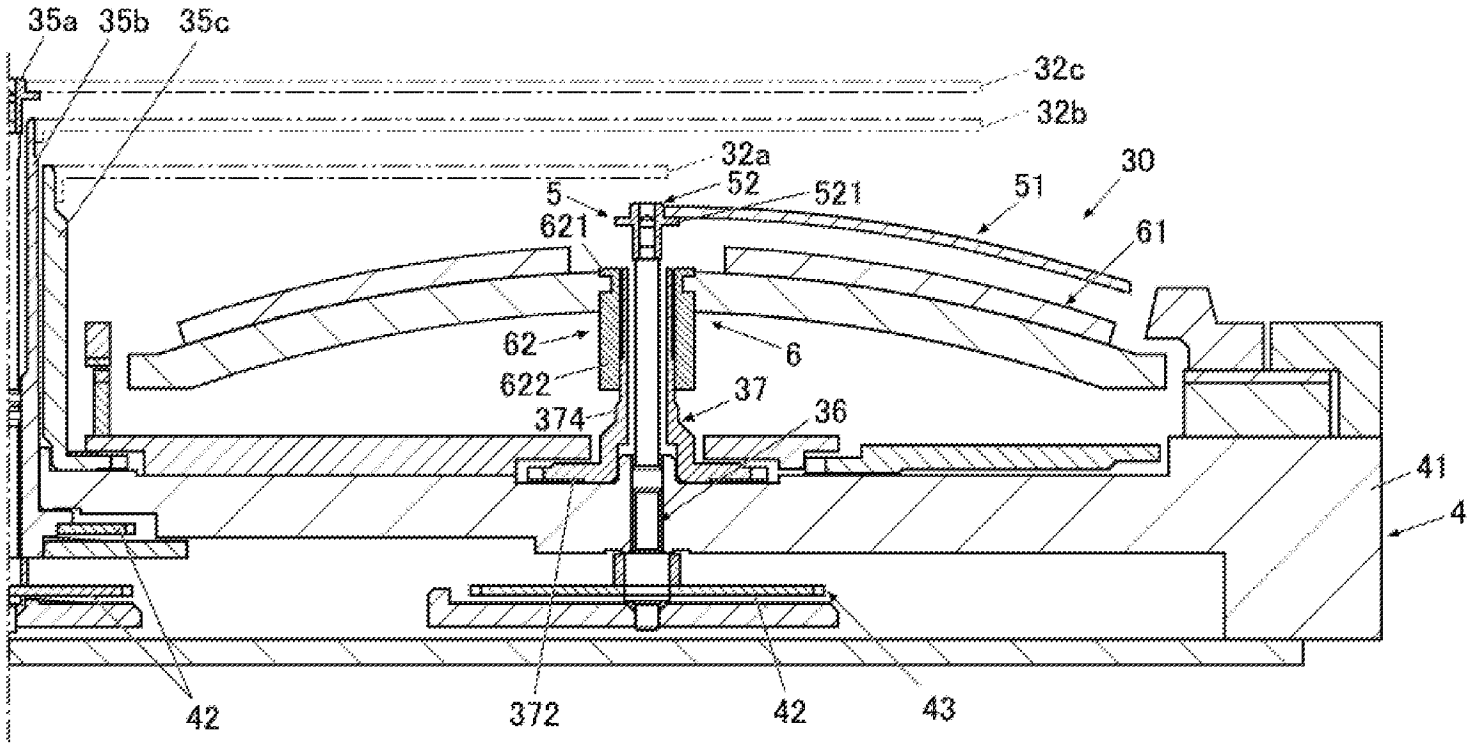
FIG. 5 is a cross-sectional view of main components of the timepiece according to a modification example.
Figure 6:
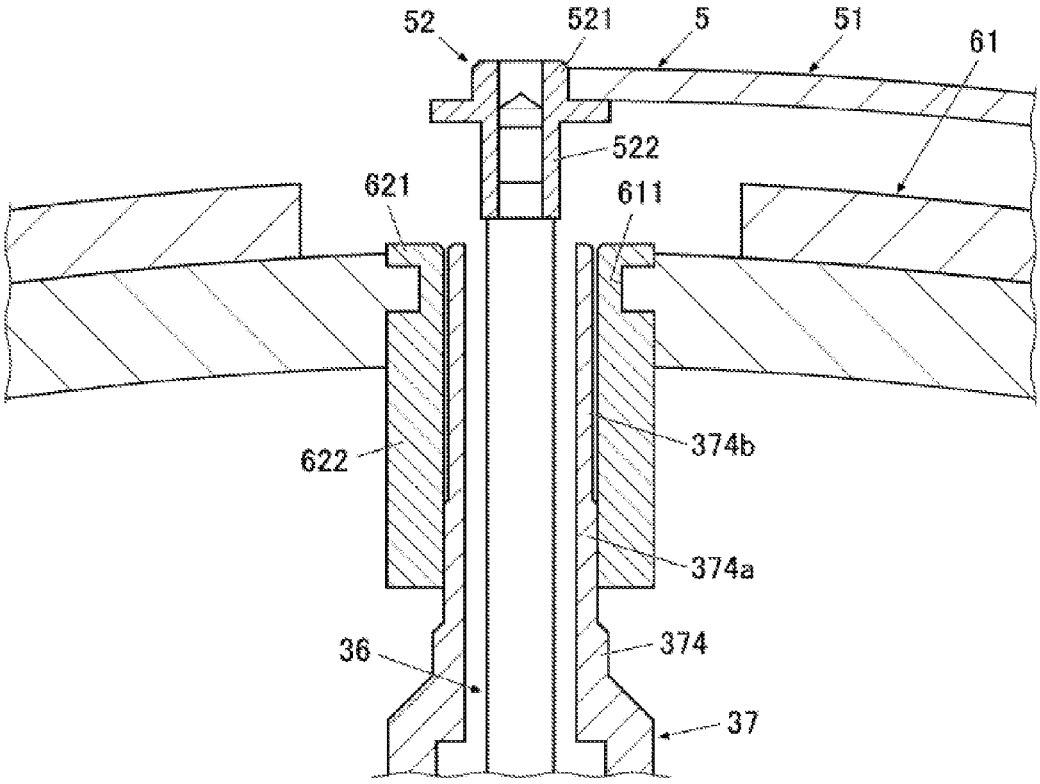
FIG. 6 is a cross-sectional view in which a fixing part of the hand unit and a hand shaft from FIG. 5 have been expanded.

As shown in FIGS. 5 and 6, for example, the top of the cylindrical part 374 of the hand shaft 37, which is a shaft unit, may be at approximately the same position as the top of the attachment member 62. In this case, the cylindrical part 374 is constituted by a pressing section 374*a* to which the cylindrical part 622 of the attachment member 62 is pressure-fitted, and a narrow shaft section 374*b* that is narrower in diameter than the pressing section 374*a*. The narrow shaft section 374*b* continues from the pressing section 374*a*. In a state in which the attachment member 62 has been pressure-fitted to the hand shaft 37, the tip of the narrow shaft section 374*b* will be approximately the same position as the top of the attachment member 62.

Configuring the hand shaft 37 in this manner makes it possible, when pressure-fitting the attachment member 62 to the hand shaft 37, to use the cylindrical part 374 as a guide and to improve positioning characteristics during pressing. Furthermore, if the tip of the narrow shaft section 374*b*, which is the tip of the hand shaft 37, is pressed until the tip is at an approximately equal position to the top of the attachment member 62, it can be ascertained that the attachment member 62 has been suitably fixed to the hand shaft 37, thereby serving as a general guide on the status of the pressing. This makes it possible to prevent damage to the hand shaft 37 or attachment member 62 due to pressing the attachment member 62 in too far or to prevent the attachment member 62 from becoming detached from the hand shaft 37 due to insufficient pressing.

In addition, the portion where the pressing section 374*a* where the cylindrical part 622 of the attachment member 62 is pressure-fitted and the inner side face of the cylindrical part 622 contact each other is only one portion of the cylindrical part 622, and the tip side of the cylindrical part 374 provides a gap between the inner side face of the cylindrical part 622 and the outer side face of the cylindrical part 374 in the form of the narrow shaft section 374*b*. Due to this, when pressure-fitting the attachment member 62 to the hand shaft 37 or removing the attachment member 62 from the hand shaft 37, it is possible to prevent unnecessary levels of force and damaging of the hand shaft 37 or attachment member 62 due to overloads.

In the present embodiment, an example was shown having a hand unit 5 provided with a functional hand 51 as a rod-shaped hand above a hand unit 6 provided with a functional hand 61 as a disk hand. However, the small display unit 30 may alternatively be constituted by only the hand unit 6, without providing the hand unit 5.

In such a case, it is not necessary to have the hand shaft 36 go through the inside of the hand shaft 37, and the hand shaft 37 can be a simple shaft without a cylindrical shape. Furthermore, in such a case, it is not necessary to have an opening on top of the attachment member 62, and thus the top of the attachment member 62 may be closed. If the top of the attachment member 62 is closed in this manner, then as shown in FIGS. 5 and 6, for example, when the hand shaft 37 extends to the top of the attachment member 62, the hand shaft 37 can be inserted until reaching the top face of the attachment member 62, which makes it easy to verify whether the hand shaft has been pressed into a suitable location, thereby making it possible to improve pressing characteristics.

Furthermore, in the present embodiment, a configuration was used in which the hand 61 and the attachment member 62 constituting the hand unit 6 are provided as separate members, but the hand 61 and the attachment member 62 may alternatively be integrally formed by insert molding or the like.

In such a case, extending the cylindrical part 622 of the attachment member 62 to be the same as or lower in position than the free end of the hand 61 improves the positioning characteristics of the attachment member 62 during insert molding and makes manufacturing easier.

In the present embodiment, an example was shown in which the hand unit 6 is applied to a timepiece 100, but apparatuses to which the hand unit of the present invention can be applied are not limited to timepieces.

The hand unit of the present invention is widely applicable, as long as the apparatus has a hand that fits to a hand shaft.

Several embodiments of the present invention were described above, but the scope of the present invention is not limited to these and includes the scope of the invention as described in the claims and the equivalents thereto.

It will be apparent to those skilled in the art that various modification and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A hand unit for a timepiece, comprising:

a hand for indicating time;

a hand movement unit that moves the hand, the hand movement unit including an inner hand shaft and an outer hand shaft that has a cylindrical part; and an attachment member including a support part attached to a rotational center of the hand so as to support the hand, and a cylindrical part defining a rotational axis of said hand and configured to be attached to a rotating shaft in the timepiece, the cylindrical part continuing from the support part extending towards a rear side of the timepiece along the rotational axis, wherein the outer hand shaft of the hand movement unit is inserted inside the cylindrical part of the attachment member, wherein the cylindrical part of the outer hand shaft is pressure-fitted to the cylindrical part of the attachment member such that only a lower portion of the cylindrical part of the attachment member that is located at the rear side of the timepiece is in contact with the cylindrical part of the outer hand shaft, and wherein a bottom of the cylindrical part of the attachment member is at a position that is approximately the same or lower than a tip of the hand.

2. The hand unit according to claim 1, wherein the hand has a disk-shape profiled such that the rotational center of the hand is highest and the disk-shape becomes progressively lower towards the tip of the hand, and wherein the rotational center of the hand has a hole formed therein, and the support part is attached in the hole.

3. A timepiece, comprising:

the hand unit according to claim 1; and a timepiece case housing the hand unit and the hand movement unit.

4. A timepiece, comprising:

the hand unit according to claim 2; and a timepiece case housing the hand unit and the hand movement unit.

5. The timepiece according to claim 3, further comprising:

a thin hand that is thinner than the hand and attached above the hand, said thin hand slanted along a surface shape of the hand.

6. The timepiece according to claim 4, further comprising:

a thin hand that is thinner than the hand and attached above the hand, said thin hand slanted along a surface shape of the hand.

7. The timepiece according to claim 3, wherein a top of the rotating shaft is at a position that is approximately the same as a top of the attachment member.

8. The timepiece according to claim 4, wherein a top of the rotating shaft is at a position that is approximately the same as a top of the attachment member.

9. The timepiece according to claim 5, wherein a top of the rotating shaft is at a position that is approximately the same as a top of the attachment member.

10. The timepiece according to claim 6, wherein a top of the rotating shaft is at a position that is approximately the same as a top of the attachment member.

* * * * *